United States Patent [19]

Sakaguchi et al.

[11] Patent Number: 4,996,125

[45] Date of Patent: Feb. 26, 1991

[54] ELECTROPHOTOGRAPHIC PHOTORECEPTOR CONTAINING A FLUORINE LUBRICATING AGENT LAYER

[75] Inventors: Yasuo Sakaguchi; Ichiro Takegawa; Makoto Takemoto; Masanori Murase, all of Kanagawa, Japan

[73] Assignee: Fuji Xerox Co., Ltd., Tokyo, Japan

[21] Appl. No.: 293,282

[22] Filed: Jan. 4, 1989

[30] Foreign Application Priority Data

Jan. 7, 1988 [JP] Japan ..... 63-000725

[51] Int. Cl.[5] ..... G03G 5/14

[52] U.S. Cl. ..... 430/66

[58] Field of Search ..... 430/66, 65, 84

[56] References Cited

U.S. PATENT DOCUMENTS 4,792,507 12/1988 Yoshihara ..... 430/67

4,803,140 2/1989 Hiro ..... 430/67

FOREIGN PATENT DOCUMENTS 61-205950 9/1986 Japan .

*Primary Examiner*—John Goodrow

*Attorney, Agent, or Firm*—Finnegan, Henderson, Farabow, Garrett, and Dunner

[57] ABSTRACT

An electrophotographic photoreceptor for use in electrophotography having a photosensitive layer on an electrically conductive substrate. A fluorine-containing lubricating layer is further place upon the photosensitive layer. The fluorine-containing lubricating agent is selected from perfluoroalkyl polyether or its derivatives.

7 Claims, No Drawings

ELECTROPHOTOGRAPHIC PHOTORECEPTOR CONTAINING A FLUORINE LUBRICATING AGENT LAYER

FIELD OF THE INVENTION

The present invention relates to electrophotographic photoreceptors and more specifically to a photoreceptor having a photosensitive layer containing a fluorine lubricating agent layer.

BACKGROUND OF THE INVENTION

Many products have been utilized as electrophotographic photoreceptors in electrophotography. Electrophotographic photoreceptors are used in the processes of charging, exposure and development. Examples of electrophotographic photoreceptors include: (1) light conductive organic materials directly applied onto a suitable conductive substrate by coating or by deposition; (2) inorganic photoconductive materials such as ZnO and CdS dispersed in binder resin; (3) amorphous Se, Se-Te alloy or Se-As alloy emplaced by deposition; and (4) two or more laminated layers of the above-mentioned photoconductive layers.

These conventional electrophotographic photoreceptors, when used repeatedly, tend to suffer surface damage during electrical and mechanical electrophotographic processes such as charging, exposure, development and copy cleaning There have been various prior proposals for preventing damage to the surface of the photosensitive layer by furnishing a protective surface layer on the photosensitive layer. (For example, JP-A-61-205950 (the term "JP-A" as used herein means an "unexamined and published Japanese Patent application").)

The characteristics required for protecting surface layers of electrophotographic photoreceptors are that they have the durability to withstand the several treatments involved in electrophotographic processes as described above. Because the surface layers can become contaminated by residual toner particles, paper dust from the copy paper, other charged materials, and the like, it is particularly necessary that they can be thoroughly cleaned without causing damage to the surface. The conventional art has not provided a satisfactory solution to these problems.

SUMMARY OF THE INVENTION

An object of the present invention is to provide an electrophotographic photoreceptor that offers a solution to the above-described defects of the prior technology. Another object of the present invention is to provide an electrophotographic photoreceptor having improved lubricity (lubricating property) and releasability (peeling property), and that experiences little wear from cleaning and minimum damage of the surface layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The above and other objects of the present invention are accomplished by an electrophotographic photoreceptor having a photosensitive layer on an electrically conductive substrate where a fluorine-containing lubricating agent layer is provided on the surface of the photosensitive layer. The fluorine-containing lubricating agent is selected from perfluoroalkyl polyether or its derivatives and the fluorine-containing lubricating agent layer has a thickness in the range of 100 to 5,000 Å.

DETAILED DESCRIPTION OF THE INVENTION

The electrically conductive substrate used in the electrophotographic photoreceptor of the present invention may be a metal or an alloy such as aluminum, nickel, chrome or stainless steel; a plastic film finished with a metal membrane such as aluminum, titanium, nickel, chrome, SUS (stainless steel), gold, vanadium, tin oxide, indium oxide or ITO; or paper or plastic film that has been coated with or immersed in a conductivity imparting agent. These conductive substrates may be of any suitable shape, such as drums, sheets or plates.

Further, it is possible to use various known materials as the photosensitive layer. For example, it is possible to use deposition films of metals or alloys such as Se, Se-Te alloy, Se-As alloy, Se-Sb alloy and Se-Bi alloy; or organic photoconductive layers such as polyvinyl carbazole or 2,4,7-trinitrofluorenone; a-Si sensitive layers; photosensitive layers of inorganic photoconductors such as ZnO or CdS dispersed in binder resin; or laminates of a charge generating layer and a charge transporting layer.

The photosensitive layer has a thickness in the range of generally 10 to 100 μm and preferably from 20 to 80 μm. A fluorine-containing lubricating agent layer is formed on the photosensitive layer, and the present invention utilizes perfluoroalkyl polyether or its derivatives as the resin that constructs the fluorine-containing lubricating agent layer. Specific examples offered include (1) perfluoroalkyl polyethers having a molecular weight in the range of 1500 to 7500 and preferably from 2000 to 5000, and represented by the formula $CFR^1$-$CF_2$-$O_n$ (wherein $R_1$ represents F, $CF_3$ or $CH_3$). (2) perfluoroalkyl polyethers having a molecular weight in the range of 2000 to 4000, and represented by the formula O-$C_2F_{4m}$ $CF_{2\,l}$ (wherein the ratio of m/l is generally from 1/9 to 9/1 and preferably from 3/7 to 7/3). There is at least one functional group at the carbon atom at the end of the perfluoroalkyl polyether Examples of the functional groups include -$COOR^2$ ($R^2$ represents an alkyl group having from 1 to 5 carbon atoms); -COOH; -$CH_2OH$; and -CONH-$C_6H_3(CH_3)$-NCO. More specific examples are: FONBURIN Y (i.e., $$CF_3-(O-\underset{\displaystyle CF_3}{\underset{|}{CF}}-CF-CF_2)_n,\ -(O-CF_2)_m,\ -O-CF_3);$$

FONBURIN Z series [for example, Fonburin Z $$(F\text{-}CF_2\text{-}(O\text{-}C_2F_4)_p\text{-}(O\text{-}CF_2)_q\text{-}OCF_2\text{-}OCF_3),$$

Fonburin Z DEAL $$(ROOC\text{-}CF_2\text{-}(O\text{-}C_2F_4)_p\text{-}(O\text{-}CF_2)_q\text{-}OCF_2\text{-}COOR),$$

Fonburin Z DIAC $$(HOOC\text{-}CF_2\text{-}(O\text{-}C_2F_4)_p\text{-}(O\text{-}CF_2)_q\text{-}OCF_2\text{-}COOH),$$

Fonburin Z DOL $(HO\text{-}CH_2\text{-}CF_2\text{-}(OC_2F_4)_p\text{-}(O\text{-}CF_2)_q\text{-}OCF_2\text{-}OH)$, and Fonburin Z DISOC $(OCN\text{-}C_6H_3(CH_3)\text{-}NHCO\text{-}CF_2\text{-}(O\text{-}C_2F_4)_p\text{-}O\text{-}CF_2)_q\text{-}OCF_2\text{-}COHN\text{-}C_6H_3(CH_3)\text{-}NCO)]$ made by the MONTEFURUOSU Company; and the KURAITOKKUSU Series [for example, Kuraitokkusu 143($(F-\underset{\underset{CF_3}{|}}{C}FCF\ O)-n''C_2F_5$, wherein n''' represents an integer of 10 to 60), and Kuraitokkusu 157 FS $(F(CFCF_2O)n'''-\overset{\overset{CF_3}{|}}{\underset{\underset{F}{|}}{C}}-COOH$, wherein n''' represents an integer of 5 to 24 and Mw is 1,000 to 4,200)] manufactured by the DuPont Company. Further, the above perfluoroalkyl polyethers may be synthesized by any desired method within the present invention.

One method of forming the fluorine-containing lubricating agent layer is to dissolve the above ( perfluoroalkyl polyether or its derivatives in a suitable solvent such as Freon, followed by coating and drying. The coating method may be such as dipping, spray coating, roller coating or spin coating, but is not necessarily limited to these.

Also, the thickness of the fluorine-containing lubricating agent layer is preferably in the range of 100 to 5,000 Å and more preferably from 1000 Å to 3000 Å. If the film thickness is less than 100 angstroms, the lubrication effect will be insufficient and if the film thickness is more than 5,000 angstroms, it will be unsuitable because the residual potential of the electrophotographic photoreceptor will be raised, resulting from the high electric insulation properties of the fluorine-containing lubricating agent.

The present invention will next be explained by examples.

EXAMPLE 1

An electrophotographic photoreceptor furnished with an aluminum substrate, a charge generating layer having a thickness of 0.8 μm made by dispersing dibromoanthanthron pigment (C. I. Pigment Red 168) in polyvinyl butaryl resin (BM1, made by Sekisui Kagaku K.K.), and a charge transporting layer having a thickness of 20 μm made by dissolving N,N'-bis(3-methylphenyl)-[1,1'-biphenyl]-4,4-diamine in a polycarbonate resin, was dip-coated with a 0.5% by weight Freon solution of perfluoropolyether (FONBURIN Z-DISOC, molecular weight 3,000, made by MONTEFURUOSU Company) having an isocyanate terminal group, which was then dried to form a lubricating agent layer having a thickness of 200 angstroms. The electrophotographic photoreceptor thus obtained was mounted in an electrophotographic copier (FX-2700, made by Fuji Xerox Co., Ltd.), and copying was done. Measurements of contact angles with distilled water were made with the photosensitive layer surface immediately after drying of the fluorine-containing lubricating agent layer, and were made on the white background of the photosensitive layer surface after copying was done repeatedly. The results are shown in Table 1 below.

The measurements of contact angles was carried out by measuring the contact angle of distilled water on the photosensitive layer surface using the contact angle measuring device ("CA-D type" manufactured by Kyowakaimenkagaku K.K.) as described in *Composite Material Engineering*, pages 148–153 published by Nikka Giren Shuppan (September 1, 1971).

COMPARATIVE EXAMPLE 1

Using a product without forming the fluorine-containing lubricating agent layer as in Example 1, copying was done in the same manner, and the contact angles with distilled water and the photosensitive layer surface were measured The results are shown in Table 1 below.

TABLE 1

| | Example 1 | Comparative Example 1 |
|---|---|---|
| Immediately after drying | 99° ± 2° | 78° + 2° |
| White background after 500 copies | 98° ± 2° | 75° ± 2° |
| White background after 5,000 copies | 95° ± 2° | 65° ± 2° |

The contact angle shows little decrease in Example 1, as is apparent from the results of Table 1, and copy pictures of good picture quality were obtained without smeared image and blurring even after 5,000 copies, while with Comparative Example 1, blurring in the picture image was observed to occur partially.

EXAMPLE 2

An electrophotographic photoreceptor furnished ( with an aluminum substrate a photosensitive layer having a thickness of 50 μm comprising $As_2Se_3$, intermediate layer having a thickness of 0.5 μm comprising Nylon 8, and a protective layer having a thickness of 10 μm made by dispersing SnO powder of 0.5 μm average particle diameter in polyurethane resin, was dipcoated with 0.5 % by weight Freon solution obtained by mixing equivalent amounts of perfluoropolyether having an isocyanate terminal group (FONBURIN Z-DISOC, molecular weight 3,000, made by MONTEFURUOSU Company) and perfluoropolyether having an alcohol terminal group (FONBURIN Z-DOL, molecular weight 2,200, made by MONTEFURUOSU Company), which was then dried to form a fluorine-containing lubricating agent layer having a thickness of 300 angstroms. This electrophotographic photoreceptor was mounted in an electrophotographic copier (FX-4700, made by Fuji Xerox Co., Ltd.), and copying was done. Measurements of contact angles with distilled water were made with the photosensitive layer surface immediately after drying the fluorine-containing lubricating agent layer, and were made on the white background of the photosensitive layer surface after repeated copying. The results are shown in Table 2.

COMPARATIVE EXAMPLE 2

Using a product without forming the fluorine-containing lubricating agent layer as in Example 2, copying was done in the same manner, and the contact angles with distilled water and the photosensitive layer surface were measured The results are shown in Table 2.

TABLE 2

| | Example 1 | Comparative Example 2 |
|---|---|---|
| Immediately after drying | 99° ± 2° | 79° + 2° |
| White background after 500 copies | 98° ± 2° | 76° ± 2° |
| White background after 30,000 copies | 90° ± 2° | 64° ± 2° |

The contact angle shows little decrease in Example 2, as is apparent from the results of Table 2, and copy pictures of good picture quality were obtained without smeared image, blurring and black lines even after 30,000 copies, while with Comparative Example 2, formation of black lines and blurring in the picture image were observed to occur partially.

EXAMPLE 3

An electrophotographic photoreceptor was formed in the same manner as in Example 1, except that the thickness of the fluorine-containing lubricating agent layer was 50 angstroms. Copying was done in the same manner as in Example 1 using this electrophotographic photoreceptor, and the same evaluations as in Example 1 were performed. The results are shown in Table 3.

TABLE 3

| | |
|---|---|
| Immediately after drying | 99° + 2° |
| White background after 100 copies | 80° ± 2° |
| White background after 5,000 copies | 77° ± 2° |

The electrophotographic photoreceptor of Example 3 did not maintain the effect of the fluorine containing lubricating agent, and gave the same values in the initial period of copying as if no fluorine-containing lubricating agent layer was formed.

COMPARATIVE EXAMPLE 4

An electrophotographic photoreceptor was formed in the same manner as in Example 2, except that the thickness of the fluorine-containing lubricating agent layer was 7,000 angstroms. When copying was done using this electrophotographic photoreceptor, the copies obtained had much fogging When the surface potential of this electrophotographic photoreceptor was measured, the residual potential was found to be high.

EFFECT OF THE INVENTION

The electrophotographic photoreceptor of the present invention, because it furnishes a fluorine-containing lubricating agent layer having a thickness of 100 to 5,000 angstroms comprising perfluoroalkyl polyether or its derivatives in its photosensitive layer surface, is superior to conventional products of synthetic resin with respect to lubricity, releasability and water and oil repellency. The present invention controls defects in picture quality such as image blurring, smeared image and black lines in which applicants infer as being caused by toner and paper dust sticking and accumulating Since the residual potential is low, picture images with low fogging are obtained. Further, longer life is achieved because of superior durability.

Additional advantages and modifications will readily occur to those skilled in the art The invention in its broader aspects is, therefore, not limited to the specific details, and illustrative examples described Accordingly, departures may be made from such details without departing from the spirit or scope of the general inventive concept as defined by the appended claims and their equivalents.

What is claimed is:

1. An electrophotographic photoreceptor comprising an electrically conductive substrate having thereon a photosensitive layer, wherein a fluorine-containing lubricating agent layer comprising a fluorine-containing lubricating agent selected from perfluoroalkyl polyether or a derivative thereof and having a thickness in the range of from 100 to 5000 angstroms is provided on the surface of said photosensitive layer, said perfluoroalkyl polyether or derivative thereof having at least one functional group at the end carbon atom, said functional group being a member selected from the group consisting of $-COOR^2$ ($R^2$ being an alkyl group having from 1 to 5 carbon atoms); -COOH; $-CH_2OH$; and $-CONH-C_6H_3(CH_3)-NCO$, and said perfluoroalkyl polyether or derivative thereof having a molecular weight in the range of from 1,500 to 7,500 is represented by the formula (I):

$$-(CFR^1-CF_2-O)_n- \quad (I)$$

in which $R^1$ represents F, $CF_3$ or $CH_3$, and n represents an integer.

2. An electrophotographic photoreceptor comprises an electrically conductive substrate having thereon a photosensitive layer, wherein a fluorine-containing lubricating agent layer comprising a fluorine-containing lubricating agent selecting from perfluoroalkyl polyether or a derivative thereof and having a thickness in the range of from 100 to 5000 angstroms is provided on the surface of said photosensitive layer, said perfluoroalkyl polyether or derivative thereof having at least one functional group at the end carbon atom, said functional group being a member selected from the group consisting of $-COOR^2$ ($R^2$ being an alkyl group having from 1 to 5 carbon atoms); -COOH; $-CH_2OH$; and $-CONH-C_6H_3(CH_3)-NCO$, and said perfluoroalkyl polyether or derivative thereof having a molecular weight in the range of from 2,000 to 4,000 is represented by the formula (II):

$$-(O-C_2F_4)_m-(O-CF_2)_l- \quad (II)$$

in which m and l each represent an integer, and the ratio of m/l is from 1/9 to 9/1.

3. The electrophotographic photoreceptor as claimed in claim 2, wherein the ratio of m/l is from 3/7 to 7/3.

4. The electrophotographic photoreceptor as claimed in claim 1, wherein said photosensitive layer has a thickness in the range of from 10 to 100 microns.

5. The electrophotographic photoreceptor as claimed in claim 2, wherein said photosensitive layer has a thickness in the range of from 10 to 100 microns.

6. The electrophotographic photoreceptor as claimed in claim 1, wherein said photosensitive layer has a thickness in the range of from 20 to 80 microns.

7. The electrophotographic photoreceptor as claimed in claim 2, wherein said photosensitive layer has a thickness in the range of from 20 to 80 microns.

* * * * *

UNITED STATES PATENT AND TRADEMARK OFFICE

CERTIFICATE OF CORRECTION

PATENT NO. : 4,996,125

DATED : February 26, 1991

INVENTOR(S) : Yasuo Sakaguchi, et. al.

It is certified that error appears in the above-identified patent and that said Letters Patent is hereby corrected as shown below:

In the Abstract, line 4, "place" should be --placed--;

Column 6, line 29, "comprises" should be --comprising--.

Column 6, line 33, "selecting" should be --selected--.

Signed and Sealed this

Fifteenth Day of December, 1992

*Attest:*

DOUGLAS B. COMER

*Attesting Officer*

*Acting Commissioner of Patents and Trademarks*